US012577029B2

(12) United States Patent
King

(10) Patent No.: US 12,577,029 B2
(45) Date of Patent: Mar. 17, 2026

(54) TOWEL COOLER ASSEMBLY

(71) Applicant: Curtis C. King, Texarkana, TX (US)

(72) Inventor: Curtis C. King, Texarkana, TX (US)

( * ) Notice: Subject to any disclaimer, the term of this patent is extended or adjusted under 35 U.S.C. 154(b) by 109 days.

(21) Appl. No.: 18/335,778

(22) Filed: Jun. 15, 2023

(65) Prior Publication Data

US 2023/0406596 A1 Dec. 21, 2023

Related U.S. Application Data

(60) Provisional application No. 63/352,560, filed on Jun. 15, 2022.

(51) Int. Cl.

| | |
|---|---|
| ***B65D 81/22*** | (2006.01) |
| *A47K 10/02* | (2006.01) |
| *F25D 3/02* | (2006.01) |
| *F25D 23/06* | (2006.01) |

(52) U.S. Cl.

CPC ..... *B65D 81/22* (2013.01); *A47K 10/025* (2013.01); *F25D 3/02* (2013.01); *F25D 23/069* (2013.01)

(58) Field of Classification Search

CPC .. F25D 3/00; F25D 2303/08; F25D 2303/081; F25D 23/069; B65D 81/22; A47K 10/025

See application file for complete search history.

(56) References Cited

U.S. PATENT DOCUMENTS

| | | | | |
|---|---|---|---|---|
| 4,424,687 | A * | 1/1984 | Morgan | F25D 3/08 62/457.1 |
| 6,227,004 | B1 * | 5/2001 | Gerstein | A47G 19/2288 62/421 |
| 10,969,166 | B2 * | 4/2021 | Perkins | F25D 31/007 |
| 2003/0101744 | A1 * | 6/2003 | Harper | F25D 3/08 62/461 |
| 2007/0052331 | A1 * | 3/2007 | Newman | F25D 23/069 312/194 |
| 2011/0056232 | A1 * | 3/2011 | Reese | F25D 31/007 62/457.5 |

FOREIGN PATENT DOCUMENTS

| | | | | |
|---|---|---|---|---|
| KR | 20120038044 | A * | 4/2012 | F25D 23/12 |

OTHER PUBLICATIONS

Machine Translation KR20120038044 (Year: 2012).*

* cited by examiner

*Primary Examiner* — Joseph F Trpisovsky
(74) *Attorney, Agent, or Firm* — Law Office of Jeff Williams PLLC; J. Oliver Williams

(57) ABSTRACT

A towel cooler assembly includes a container body with removable lid that is configured to seal an interior volume. Within the volume is stored a cooling medium and a fabric divided by a removable divider. The assembly is configured to internally house an absorbent fabric and locate such fabric adjacent to a cooling medium such as water in a liquid or solid state. The assembly is configured to include a divider which selectively allows passage between the cooling medium and the fabric. The fabric remains at a cool temperature similar to the cooling medium.

9 Claims, 3 Drawing Sheets

TOWEL COOLER ASSEMBLY

CROSS REFERENCE TO RELATED APPLICATIONS

This application claims the benefit of an earlier filing date and right of priority to U.S. Provisional Application No. 63/352,560, filed 15 Jun. 2022, the contents of which is incorporated by reference herein in its entirety.

BACKGROUND OF THE INVENTION

1. Field of the Invention

The present application relates to a cooler, and more particularly to a personal use cooler for the cooling of a towel or other object.

2. Description of Related Art

People often get warm and need to cool down in the heat. A common method is to pour cool water on the skin in an effort to lower body temperature. A disadvantage to this method is the water quickly falls away from the skin thereby providing limited effect for the user. Another method is where the user can use a towel or other fabric to absorb cool water and apply it to their skin as a method of cooling down. A cooling bath used is often just poured water over a cloth. For example, often a water bottle is used to carry cooled water. The water bottle is cooled previously in a fridge or ice chest and then used to spill the water on the cloth. The cloth holds the water over the skin better than strait pouring it on the user. However, this method still involves pouring water out of a container to reach the absorbing fabric. A good portion of cooled water is lost in this process. This necessitates the use of multiple water bottles. No recovery of excess water is permitted and the water once absorbed by the fabric instantly begins to heat up. Another disadvantage is that the fabric is often stored away from the cooled temperatures of the water bottle. An equalizing temperature gradient begins to occur the moment the water hits the fabric.

Although strides have been made, shortcomings remain. It is desired that an assembly be provided that allows a dedicated cooler for both the fabric that is self-contained and reusable and the cooled water within the water bottle.

BRIEF SUMMARY OF THE INVENTION

It is an object of the present application to provide a towel cooler assembly configured to store both cooled water and an absorbing cloth fabric internally. The assembly is configured to include a divider so as to solid or frozen portions of the cooled medium (i.e. water) from the absorbing fabric while allowing the cooled water to contact the absorbing fabric. It is also an object of the present application to accept cooled water in both solid and liquid form. Usage of the towel cooler assembly allows the absorbing fabric to remain saturated with the cooled water. Thereby the temperature of the fabric and the cooled water remain equalized.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated.

Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
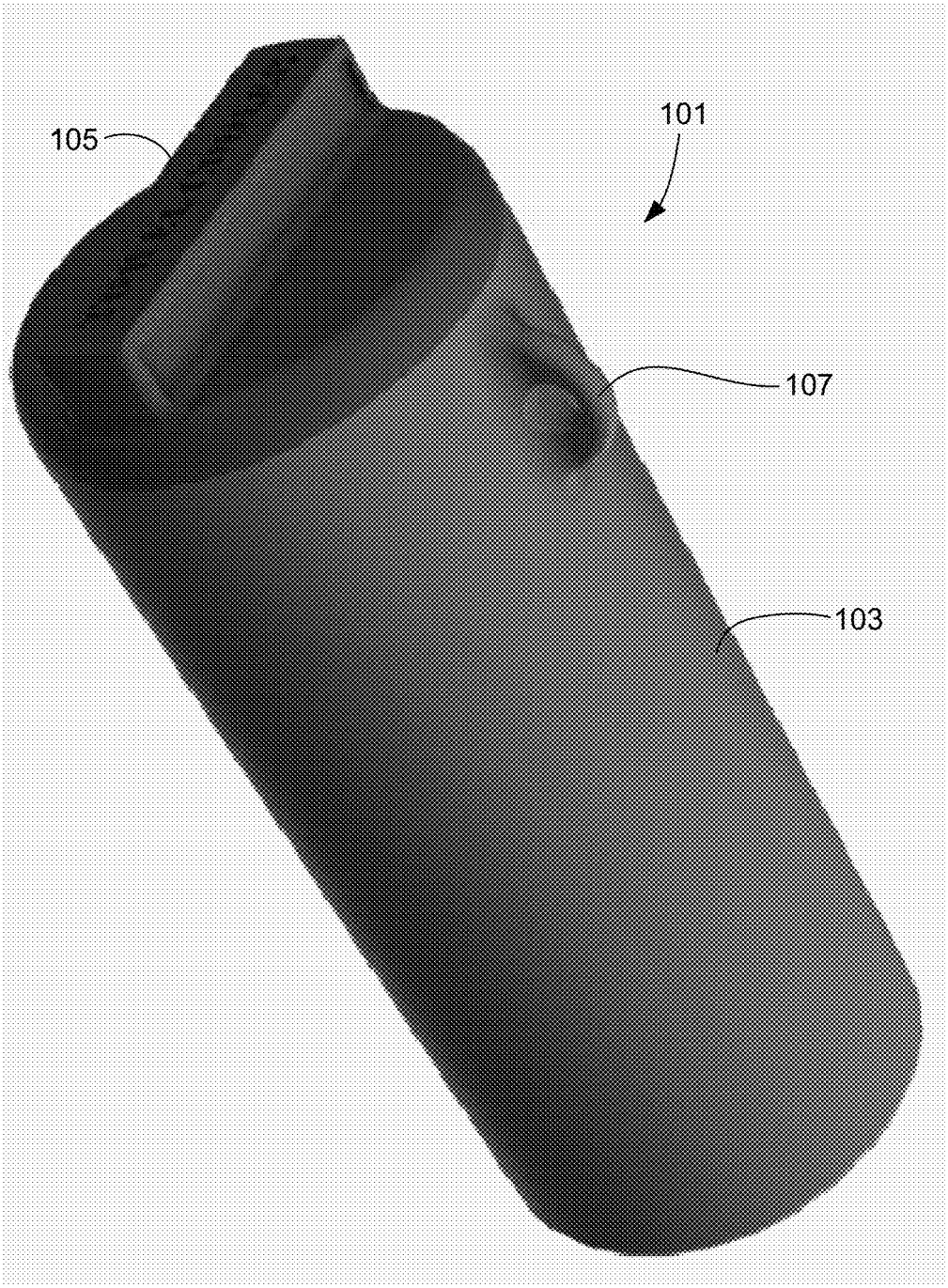
FIG. 1 is a perspective view of a towel cooler assembly according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with the prior art discussed previously. In particular, the towel cooler assembly of the present application is configured to internally house an absorbent fabric and locate such fabric adjacent to a cooling medium such as water in a liquid or solid state. The assembly is configured to include a divider which selectively allows passage between the cooling medium and the fabric. The fabric remains at a cool temperature similar to the cooling medium. Additionally the assembly minimizes wasted cooling medium as saturation of the fabric occurs internally within a sealed container. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The embodiments and method of the present application is illustrated in the associated drawings. The Towel cooler assembly includes a container body with removable lid that is configured to seal an interior volume. Within the volume is stored a cooling medium and a fabric divided by a removable divider. Additional features and functions are illustrated and discussed below.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

The assembly of the present application is configured to provide a self contained and portable cooler for the storage of cloth or other absorbent flexible material or fabric, such as a towel. An object of the present cooler is to provide an internal compartment or space within a central body to keep or store the fabric. A divider is used as a screen or grate to provide to create a separation between the fabric and the cooling medium. The cloth is able to become fully saturated with the cooling liquid over time and be ready for use by the user. A user may then access the cloth without spilling the cooling liquid via an exterior opening.

Referring now to FIG. 1 in the drawings, a perspective view of a towel cooler assembly 101 is provided. The towel cooler assembly 101 includes a container body 103 having an opening at one end. As illustrated body 103 is cylindrical in form and is configured to define an internal volume. Assembly 101 further includes a removable lid 105 configured to selectively seal the opening of the container body 103. Body 103 may include one or more formed features to enhance functionality for a user. An example of such feature may include a formed aperture 107 extending externally from body 103. This may be used to pass a rope, hook, or clip so as to attach it to another object. It is understood that the exact external form and shape of body 103 is not limited to that form illustrated in the figures. Various different shapes and forms may be desired and are considered amenable to the present application.

Figure 2:
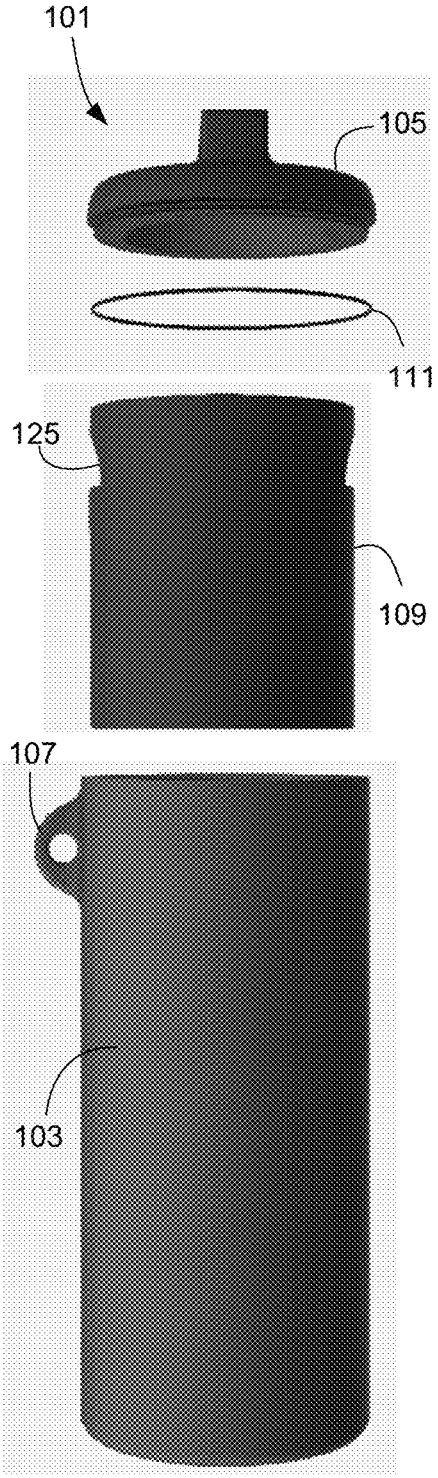
FIG. 2 is an exploded view of the towel cooler assembly of FIG. 1.

Referring now also to FIG. 2 in the drawings, an exploded view of the towel cooler assembly 101 is provided. Figure two is useful to illustrate divider 109 that is configured to reside within the interior volume of container body 103. Divider 109 is configured to slide adjacent the interior walls of body 103 and create an interior pocket for locating the fabric 108 (see FIG. 3). Removable lid 105 includes a seal 111 configured to contact a rim of body 103 so as to prevent the spillage or leakage of cooling medium 120 (see FIG. 3) from the internal volume of body 103.

Referring now also to figure three in the drawings, a section view of assembly 101 is shown. The section view is taken along the length of body 103 and is useful in locating divider 109 within the internal volume. Assembly 101 is configured to suspend or locate divider 109 in a manner that prevents divider 109 from falling through the interior volume to a base surface in container 103. This may be done in various different ways.

Figure 3:
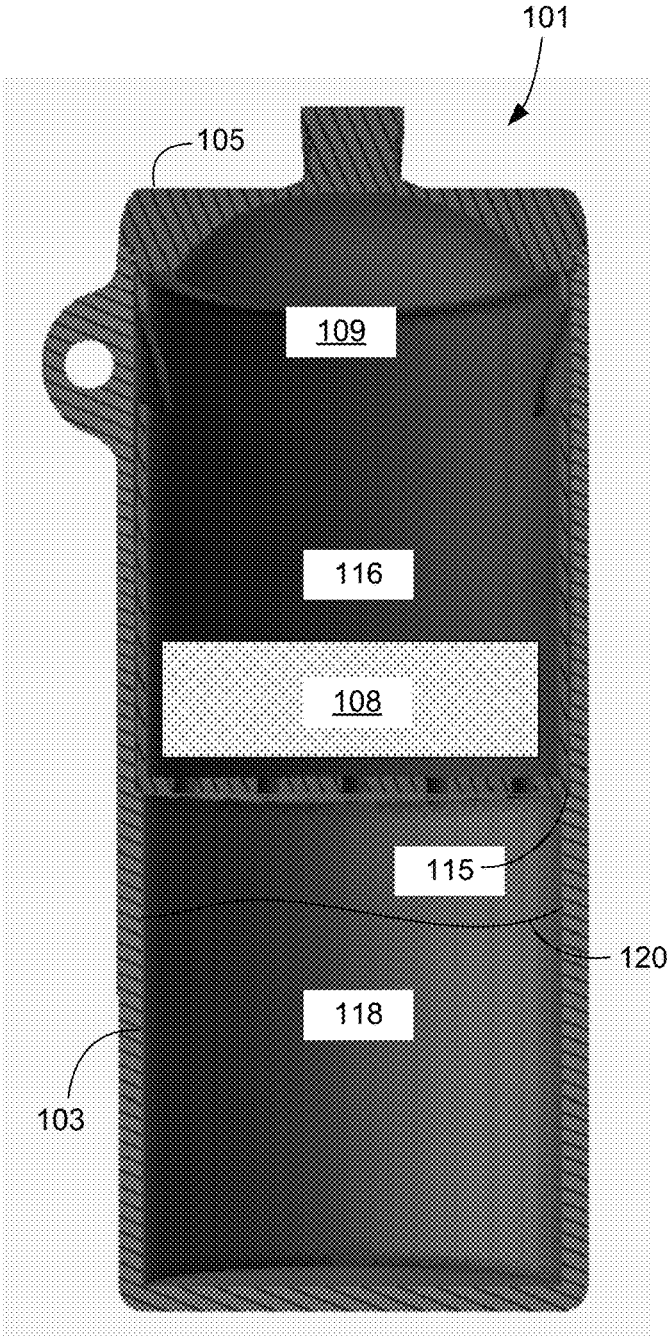
FIG. 3 is a section view of the towel cooler assembly of FIG. 1.

One such method is shown in FIG. 3 wherein the interior surface of the container body 103 includes a ridge or lip 115. In the illustrated embodiment the wall thickness of body 103 below divider 109 is thicker than the wall thickness of body 103 adjacent to divider 109. The change in wall thickness creates an internal ledge that supports divider 109. It is desired that the location of the ridge or lip 115 be located so as to be sufficient to secure lid 105 two body 103 when divider 109 is located therein. In other embodiments body 103 may include a lip 115 which may be no more than an internal extending ridge at a certain location down from the opening of body 103. It is important to note that all that is required is successfully locating divider 109 adjacent the opening of container body 103.

Divider 109 is formed in a similar shape to that of container body 103. Within its interior volume 116 would be the storage of the absorbent fabric. Below divider 109 within the interior volume of container body 103 is a lower interior volume 118 for the storage of the cooling medium. As seen in FIG. 3 a series of apertures 117 is located along bottom surface 119 of divider 109. Apertures 117 may include any shape or be of any size. A purpose of apertures 117 is to allow the passage of cooling medium from a lower interior volume to an interior volume of divider 109.

Figure 4:
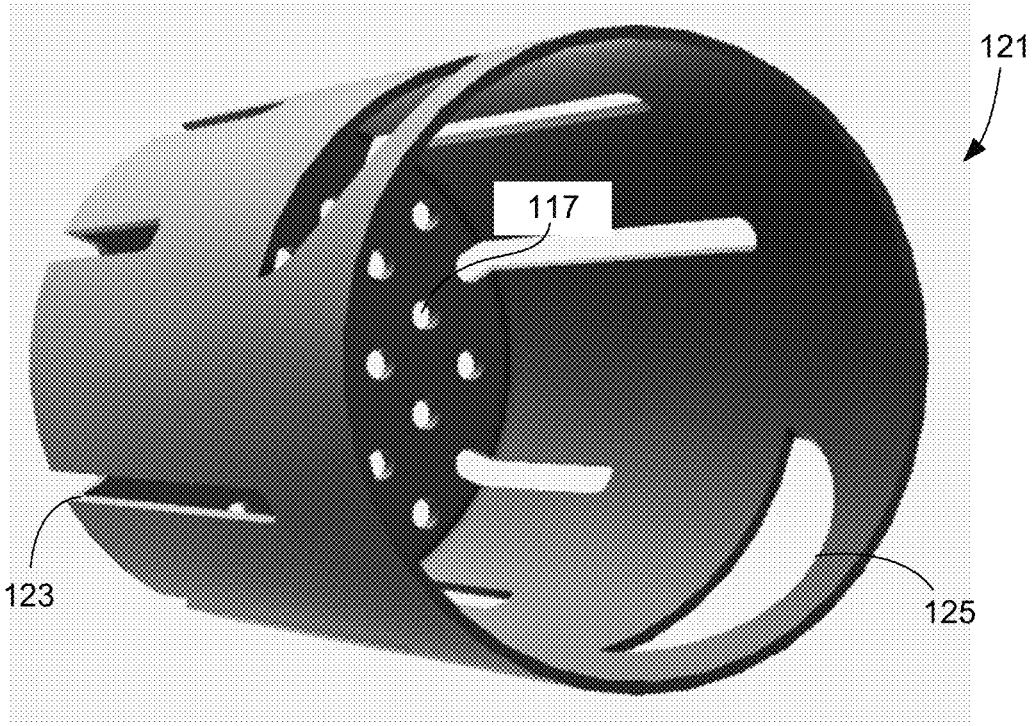
FIG. 4 is a perspective view of an alternate divider used in the towel cooler assembly of FIG. 1.
Figure 5:
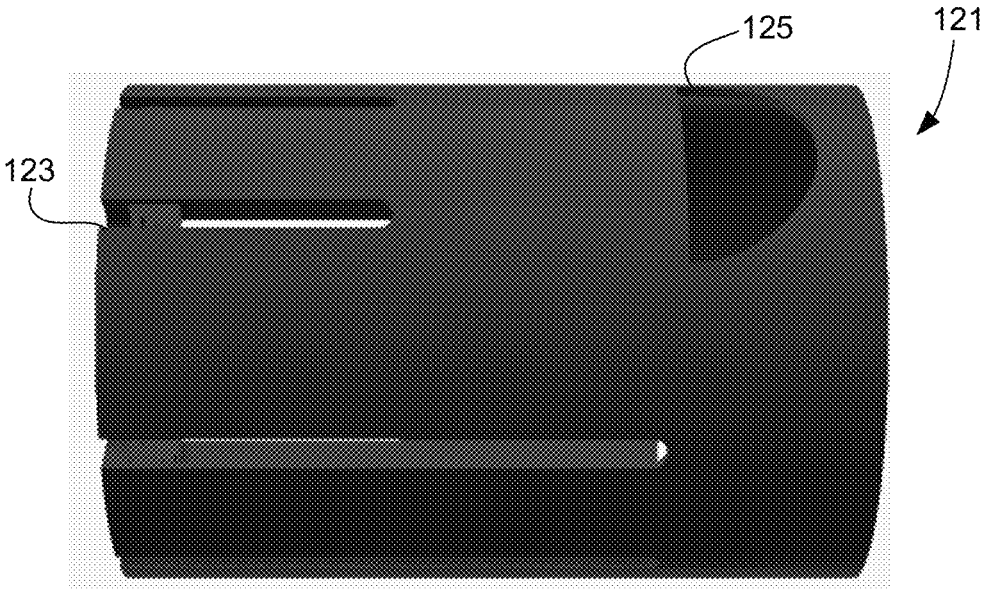
FIG. 5 is a side view of the divider of FIG. 4.

Referring now also to FIGS. 4-5 in the drawings, views of an alternate embodiment of divider 109 are illustrated. Divider 121 is similar in form and function to that of divider 109 shown in FIGS. 1-3. Divider 121 differs from divider 109 as described herein. Whereas divider 109 includes apertures along a base surface opposite its main opening, divider 121 also includes slots or slits 123 extending along its sides. Slits 123 may extend partially into the base surface of divider 121. The size and length of slits 123 are not limited to that depicted in the Figures. Slits 123 allow extra volume of cooling medium to pass between the lower internal volume 118 and the internal volume 116 of divider 109/121. Of note is the use of cut outs 125 adjacent the opening of divider 109 and divider 121 for the purpose of allowing a user to remove divider 109 and divider 121 from body 103.

In operation a user locates a cooling medium within body 103. The cooling medium is ideally located so as to remain below lip 115, or within the lower internal volume 118 of body 103. A selected divider may be located above the cooling medium so as to rest adjacent to the opening of body 103. A fabric may be selected and placed within internal volume 116 wherein its temperature will equalize with the temperature of the cooling medium so as to maintain a consistent cooled temperature. A user may shake or reorient container body 103 so as to mix the cooling medium with the fabric wherein the cooling medium passes through the apertures and/or slots of the divider. This allows for saturation of the fabric internally and avoids leakages or spilling of the cooling medium. A user may then open and remove lid 105 to gain access to the absorbent fabric which is then saturated and ready for cooling of the user. A user may then reinsert relocate the absorbent fabric back into body 103 for re-saturation and subsequent cooling.

It is understood that container body 103 may include thermal insulating properties to resist heat transfer between the exterior environment and any internal volume. Materials for container 103 and dividers 109 and 121 are selected from rigid sturdy materials allowing for personal preference and design constraints. It is also understood that the cooling media may be a solid or liquid such as ice or chilled water. The purpose of the Towel Cooler assembly 101 is to allow users to have potable and easy access to a cool/cold wet towel to cool down in hot climates and/or after strenuous exercise. The Towel Cooler provides the ability for people to have a cool/cold wet towel anywhere they need one with exceptional portability.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A towel cooler assembly, comprising:

a container body having an opening at a first end;

a divider configured to translate within a portion of the container body, the divider configured to divide an internal volume of the container body into a lower internal volume and an upper internal volume of the divider, the divider including a base and side wall, a plurality of apertures being located in the base and side wall for passage of a cooling medium; and a releasable lid configured to secure to the opening at the first end;

a fabric located within the upper internal volume for the selective wetting of the cooling medium.

2. The assembly of claim 1, wherein the divider includes one or more slits for the passage of the cooling medium.

3. The assembly of claim 2, wherein the one or more slits extend along the side wall of the divider.

4. The assembly of claim 2, wherein the one or more slits extend along a side of the divider and partially into the base of the divider.

5. The assembly of claim 1, wherein the releasable lid includes a seal.

6. The assembly of claim 1, wherein the divider is removable from the container body.

7. A method of lowering the temperature of a surface, comprising:

obtaining a towel cooler assembly according to claim 1;

locating a cooling medium within the lower internal volume;

locating the divider within the container body;

adjusting the orientation of the container body to selectively permit the passage of the cooling medium from the lower internal volume to the upper internal volume of the divider through the base and the side wall; and selectively removing the fabric from the internal volume of the divider, the fabric being saturated with the cooling medium.

8. The method of claim 7, wherein saturation occurs in the fabric while the lid is on the container body.

9. The method of claim 7, further comprising:

removing the divider from the container body.

* * * * *